US008187052B2

(12) United States Patent
Van Dan Elzen et al.

(10) Patent No.: US 8,187,052 B2
(45) Date of Patent: May 29, 2012

(54) MOTORIZED YO-YO HAVING IMPROVED EFFICIENCY

(76) Inventors: Hans W. Van Dan Elzen, Gilbert, AZ (US); Thomas J. Van Dan Elzen, Coolidge, AZ (US)

( * ) Notice: Subject to any disclaimer, the term of this patent is extended or adjusted under 35 U.S.C. 154(b) by 187 days.

(21) Appl. No.: 12/714,507

(22) Filed: Feb. 28, 2010

(65) Prior Publication Data

US 2011/0212665 A1 Sep. 1, 2011

(51) Int. Cl.
*A63H 1/06* (2006.01)
*A63H 1/30* (2006.01)

(52) U.S. Cl. ..... 446/250; 446/247

(58) Field of Classification Search ..... 446/236, 446/247–264

See application file for complete search history.

(56) References Cited

U.S. PATENT DOCUMENTS

| | | | |
|---|---|---|---|
| 1,784,684 | A | 12/1930 | Bell |
| 3,884,317 | A | 5/1975 | Kinzel |
| 3,899,849 | A | 8/1975 | Witiak |
| 3,935,667 | A | 2/1976 | Vitt |
| 4,062,421 | A | 12/1977 | Weber |
| 4,327,518 | A | 5/1982 | Knauff |
| 5,135,425 | A | 8/1992 | Andrews et al. |
| 5,506,459 | A | 4/1996 | Ritts |
| 5,552,972 | A | 9/1996 | Rezvani |
| 5,788,007 | A | 8/1998 | Miekka |
| 5,947,790 | A | 9/1999 | Gordon |
| 6,011,337 | A | 1/2000 | Lin et al. |
| 6,287,193 | B1 | 9/2001 | Rehkemper et al. |
| 6,309,274 | B1 | 10/2001 | Thomson et al. |
| 6,579,142 | B1 | 6/2003 | Rehkemper et al. |
| 6,634,922 | B1 | 10/2003 | Driscoll et al. |
| 6,695,670 | B1 | 2/2004 | Driscoll et al. |
| 6,717,324 | B2 | 4/2004 | Chen |
| 6,770,012 | B2 | 8/2004 | Kuo |
| 6,802,385 | B2 | 10/2004 | Pyntikov et al. |
| 6,806,608 | B2 | 10/2004 | Chen |
| 7,037,169 | B2 | 5/2006 | Benedek et al. |
| 7,191,861 | B2 | 3/2007 | Bui |
| 7,448,934 | B2 | 11/2008 | Van Dan Elzen et al. |
| 7,874,891 | B2 | 1/2011 | Van Dan Elzen et al. |
| 2004/0198151 | A1 | 10/2004 | Bell |
| 2005/0048869 | A1 | 3/2005 | Osawa et al. |
| 2005/0280322 | A1 | 12/2005 | Tsou |
| 2006/0166745 | A1 | 7/2006 | Lo |

FOREIGN PATENT DOCUMENTS

| | | |
|---|---|---|
| JP | 2003126560 | 5/2003 |
| WO | WO0107131 | 2/2001 |

*Primary Examiner* — Nini Legesse
(74) *Attorney, Agent, or Firm* — Franklin Gubernick

(57) ABSTRACT

The invention is a yo-yo that that has at least one side that incorporates components that create a powered rotation system. The system is connected to either a circuit board or a weighted board that is similarly rotatable and is located in the yo-yo's other side and/or employs a circuit board that is non-symmetric about its rotational axis and/or uses the powered rotation system to only push on a side portion's body member.

20 Claims, 12 Drawing Sheets

MOTORIZED YO-YO HAVING IMPROVED EFFICIENCY

FIELD OF THE INVENTION

The invention is in the field of user-manipulated toys. More particularly, the invention is a yo-yo that has a powered rotation system in at least one of its side portions and is adapted for maximum efficiency. This is achieved by linking together components located in both of the yo-yo's side portions and/or employing a circuit board shaped to facilitate non-symmetric weighting about its rotational axis and/or using the powered rotation system to only push on a side portion's body member and/or providing an exterior-located power source.

BACKGROUND OF THE INVENTION

Most yo-yos typically comprise two disk-shaped side portions that are rigidly connected to each other by some form of axle structure. The side portions are usually of unitary construction and may be made out of plastic, metal or wood. The axle structure is normally secured to the center of both side portions and can be an assembly having multiple parts, or merely be in the form of a dowel or a riveted pin. In many modern yo-yos, a ball bearing unit, or other rotatable member, is secured to, and has at least a portion rotatable on, a center portion of the axle structure.

The axle structure also forms an anchor for one end of a string-type tether. An end-located loop portion of the tether is positioned so that it encircles a center portion of the axle structure. The free end of the tether is usually tied to create a second loop portion that can be placed about one of a user's fingers to thereby secure the yo-yo to the user's hand.

When one end of the tether is secured to a user's finger and the remainder of the tether is wound about the axle structure, the yo-yo is ready for use. When the yo-yo is released, or thrown, from the user's hand, the yo-yo will begin to rapidly spin as the tether unwinds from about the axle structure and the yo-yo moves away from the user's hand. Once the tether is fully unwound, the yo-yo may "sleep" at the end of the tether, whereby the yo-yo's side portions continue to spin without the tether rewinding on the axle structure. This is enabled by either having the tether's end loop slip on the axle structure, or by having the tether's end loop secured to a freely rotatable member that is secured to, or forms a portion of, the axle structure. Once the yo-yo is sleeping, there are a number of tricks, such as "walk the dog," that a user can perform with the spinning yo-yo.

When a typical yo-yo is sleeping at the end of the tether and the user wishes to cause the yo-yo to return to his or her hand, the user will make a quick tug/jerk on the yo-yo's tether. This results in a brief tightening of the tether, and is automatically followed by a temporary slackening of the tether. Once the tether goes slack, the tether proximate the axle structure can engage and become movable with the spinning portion of the yo-yo. Continued rotation of the spinning portion of the yo-yo will then cause the tether to wind about the axle structure, resulting in the yo-yo's return to the user's hand.

An extremely important performance characteristic of a yo-yo is its potential sleep time. Since most yo-yo tricks are performed while the yo-yo is sleeping, the longer a yo-yo can be made to sleep, the more time a user will have to complete any particular yo-yo trick. While some tricks can be performed quickly, others require a yo-yo that is capable of sleeping for a relatively long period of time.

In our U.S. Pat. No. 7,448,934 (hereby incorporated by reference), we taught a yo-yo that includes at least one powered rotation system. Said system enables a yo-yo to sleep for significantly longer than other prior art yo-yos and enables a user to perform yo-yo tricks practically without sleep time limitations. However, since said yo-yo is electrically powered, it would be advantageous to increase its efficiency to thereby either increase the time it can sleep or to be able to have the same sleep time while using less energy.

SUMMARY OF THE INVENTION

The invention is a yo-yo that has a powered rotation system in at least one of its side portions. In the invention, said system is adapted for maximum efficiency and improved operation.

An electrically-powered rotation system essentially converts a side portion of a yo-yo into a motor. To accomplish this, the system includes a plurality of permanent magnets that are spaced apart from each other and are fixedly secured to the side portion's main body. The system further includes a freely-rotatable board assembly that features a circuit board having a sensor spaced away from an electromagnet. The sensor is capable of detecting a magnetic field, and the electromagnet is capable of applying force to any magnetically-affectable member, such as one of the permanent magnets, in its vicinity. The system preferably additionally includes a controller and capacitor, both mounted on the circuit board, and a power source, such as a battery. The controller functions to actuate the electromagnet, via the capacitor, in response to a signal received from the sensor. When the yo-yo is sleeping, the rotatable mounting of the board assembly enables relative rotation between the circuit board and the permanent magnets located in the side portion's body. The weight of the board assembly provides a mass that the electromagnet pushes against as it applies force to the permanent magnets in order to maintain the rotational momentum of the side portion's rotating body.

A first improvement described herein is the use of a rod to link together a board assembly having the previously-noted electrical components to a similar board assembly located in the yo-yo's other side portion. In an alternate embodiment of the invention, the board assembly having said electrical components is linked to a board assembly that includes just a weight member and is located in the yo-yo's other side portion. By linking together board assemblies located in both of the yo-yo's side portions, this effectively doubles the mass of the rotatable board assembly used in the powered rotation system. Gravity can then act on both board assemblies simultaneously to cause both board assemblies to stabilize much faster in a final position with their center of mass located below the yo-yo's axis of rotation. Furthermore, by linking the board assemblies together, each board assembly can act to stabilize the other board assembly. By stabilizing the board assemblies, the timing of when to energize the electromagnet can be achieved more accurately, efficiently and effectively. In addition, by linking a board assembly located in one of a yo-yo's side portions to a board assembly in the other side portion, any tendency of the yo-yo toward precession is reduced since a transfer of forces, as well as an overall balancing of forces, between the yo-yo's side portions is enabled.

A second improvement described herein accrues from the preferred shape of the powered rotation system's circuit board. Said board is preferably non-symmetric about its axis of rotation and is shaped to maximize the distance of the lever arm between said axis of rotation and a center of mass of the board combined with the components mounted on said board A third improvement described herein involves the controller causing the electromagnet to be temporarily energized beginning at a time when a permanent magnet is located directly adjacent the electromagnet, and once energized, said electromagnet preferably only applies a pushing/repulsive force on said permanent magnet. This greatly facilitates the ability to properly time when the electromagnet should be actuated and maximizes the time available for applying force while eliminating energy wastage since the electromagnet is only energized when it can positively affect the body member's rotational momentum.

A fourth improvement described herein involves a novel structure for exterior mounting of the power source, or a supplemental power source, is described herein. Said structure is preferably located on a portion of the rotatable board assembly that extends outwardly from the yo-yo, is readily accessible and may include a quick-disconnect feature.

Furthermore, the powered rotation system in accordance with the invention may include one or more lights mounted on one, or both, of the yo-yo's rotatable board assemblies and controlled by the powered rotation system. Said lights can indicate information relative to the powered rotation system's operation and/or whether the power source has become significantly depleted.

A yo-yo having a powered rotation system that incorporates the enhancements noted herein to improve efficiency and ease of use enables the yo-yo to sleep for a greatly extended period of time while using a minimum of power. This enables a user to perform yo-yo tricks without having to worry about the yo-yo slowing down to a point where it will no longer return to his or her hand. The yo-yo's extremely long sleep time also enables a user to perform complicated yo-yo tricks, or a series of yo-yo tricks, or repeatedly practice the same yo-yo trick, using only a single throw of the yo-yo.

DETAILED DESCRIPTION OF THE DRAWINGS

Figure 1:
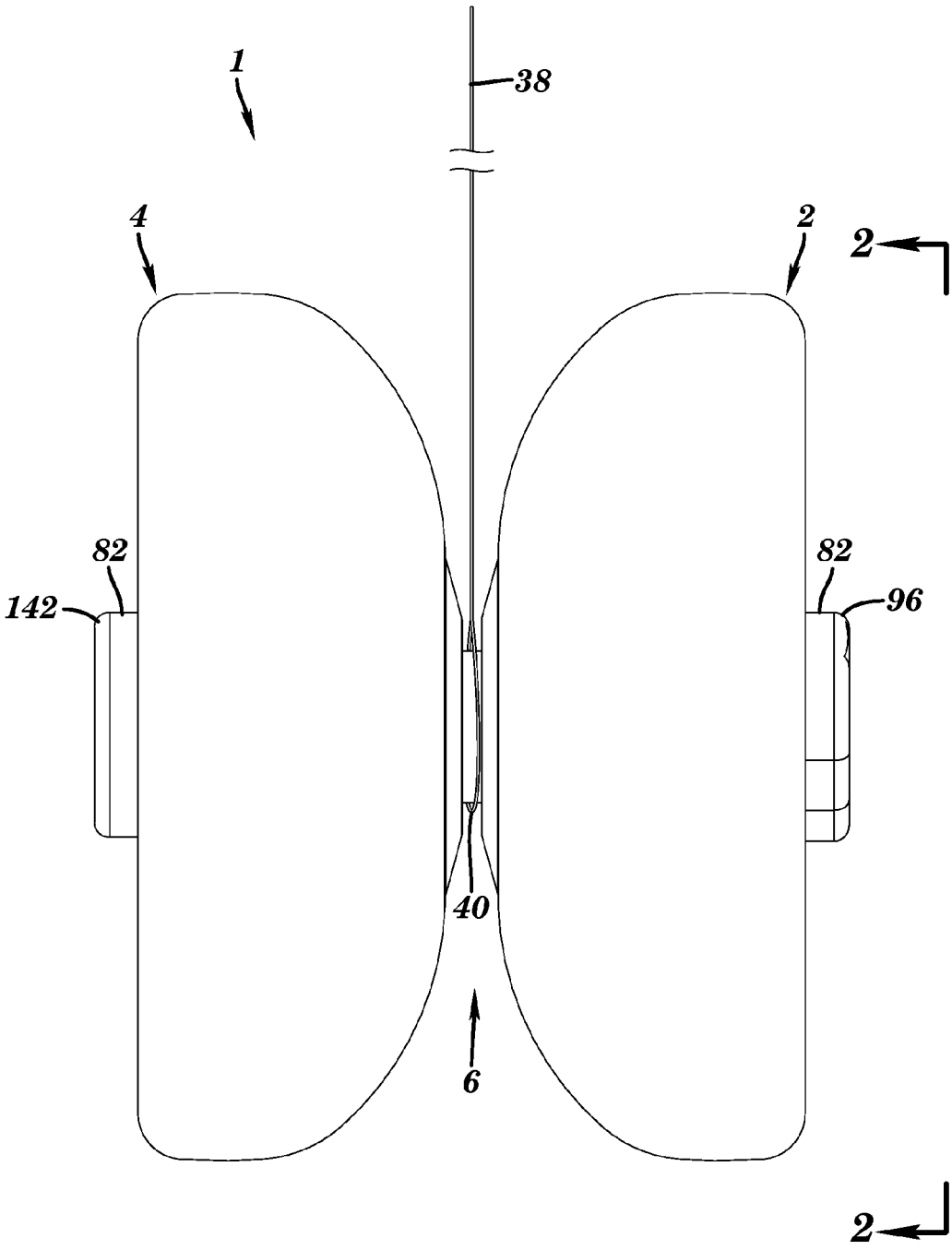
FIG. 1 is a front view of a first embodiment of a yo-yo in accordance with the invention.
Figure 2:
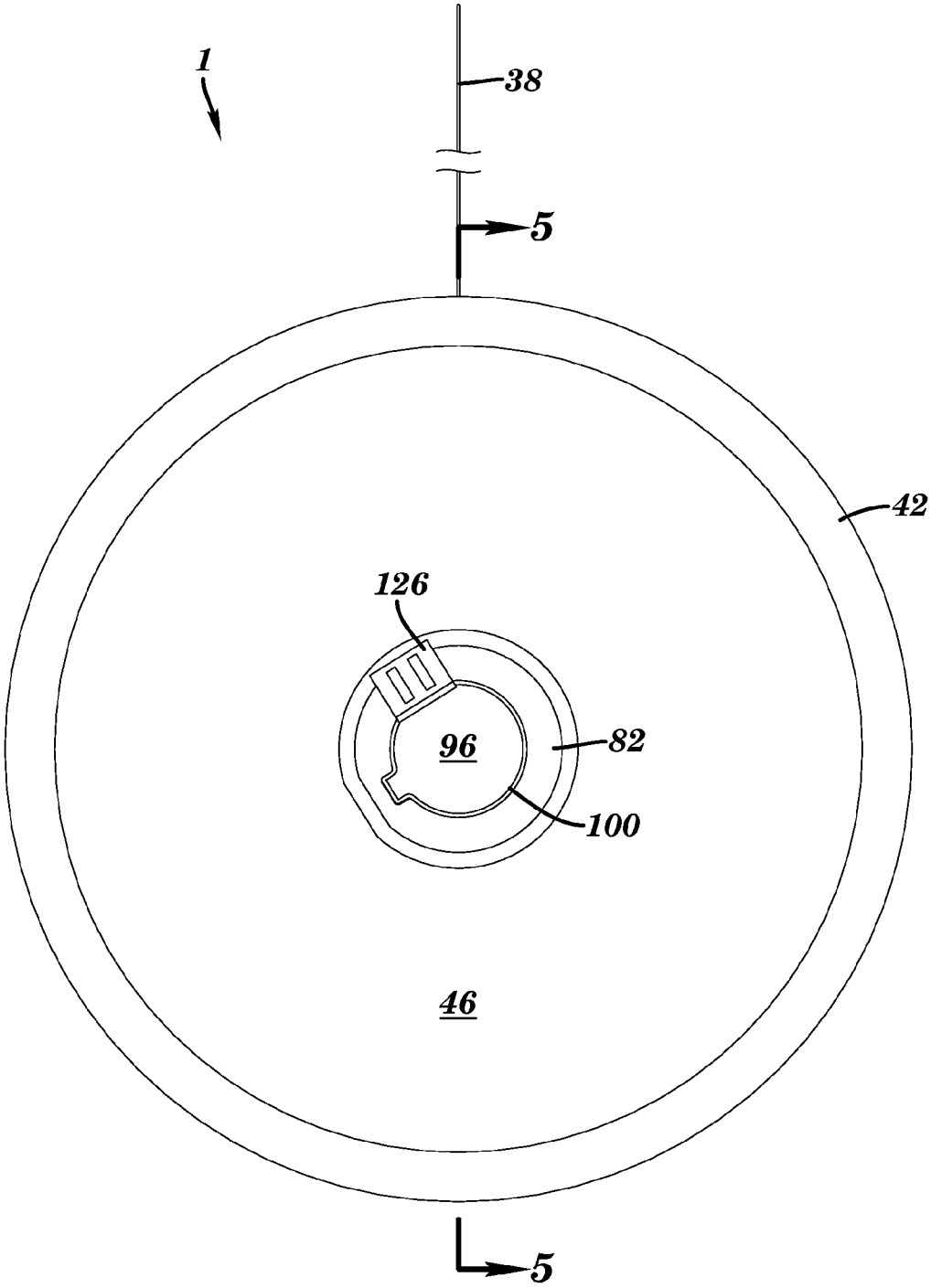
FIG. 2 is a side view of the yo-yo shown in FIG. 1, taken at the plane labeled 2-2 in FIG. 1.
Figure 3:
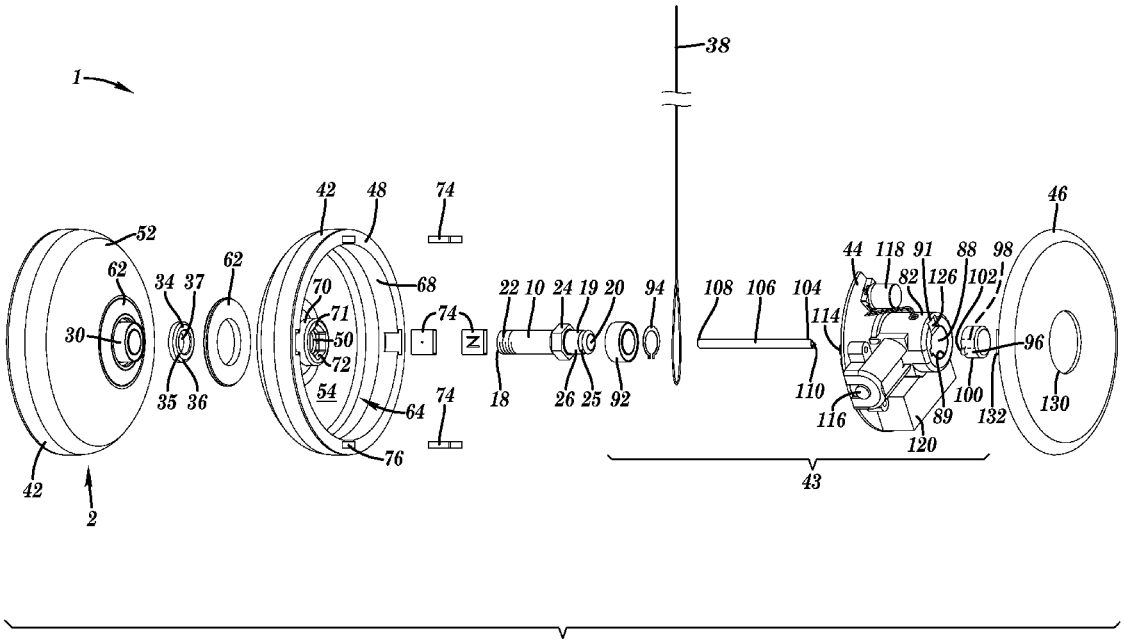
FIG. 3 is a front perspective view of the yo-yo shown in FIG. 1, with the right side of the yo-yo shown in exploded fashion.
Figure 4:
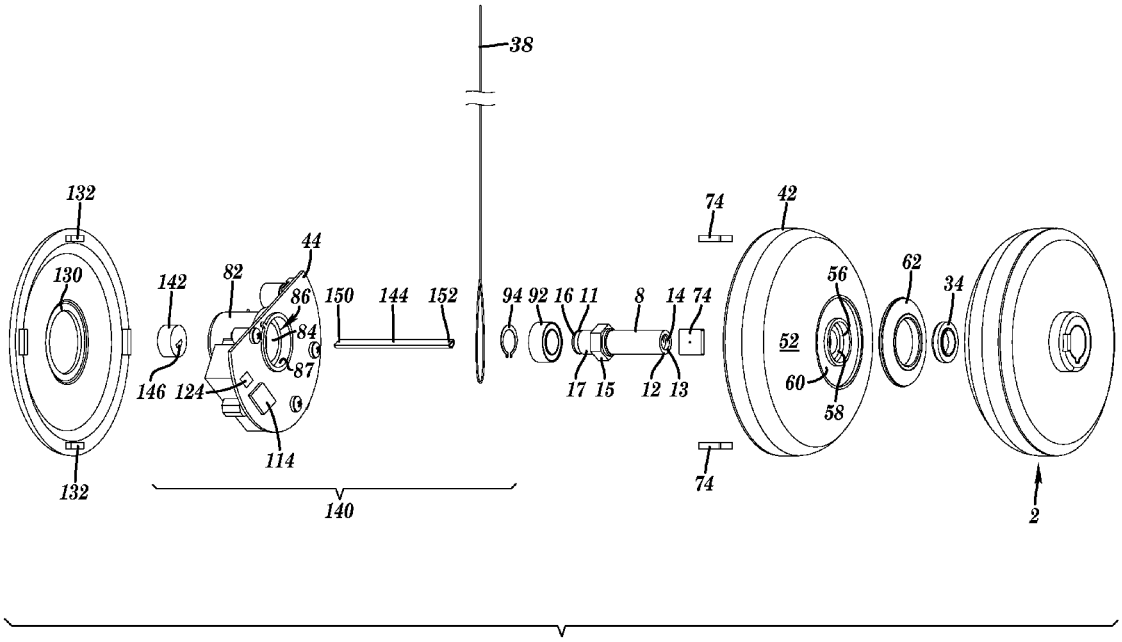
FIG. 4 is a front perspective view of the yo-yo shown in FIG. 1, with the left side of the yo-yo shown in exploded fashion.

Looking now to the drawings in greater detail, wherein like reference numerals refer to like parts throughout the several figures, there is indicated by the numeral 1 a yo-yo in accordance with the invention.

The yo-yo 1 includes a first side portion 2 and a second side portion 4. The two side portions are connected together via an axle structure 6. The axle structure is preferably an assemblage of parts and comprises a short axle tube 8 and a long axle tube 10.

The short axle tube 8 has first and second end portions, 11 and 12 respectively and a center thru-bore 13. At least a portion of the thru-bore has been tapped to feature interior threads 14. The exterior of the short axle tube's portion 11 includes a hexagonally-shaped portion 15 and a circumferentially-extending groove 16. Located between portion 15 and groove 16 is a cylindrical portion 17 that, in cross-section, has a circular outer periphery.

The long axle tube 10 has first and second end portions, 18 and 19 respectively, and a center thru-bore 20. End portion 18 is sized to fit within bore 13 of the short axle tube and features exterior threads 22 that are complementary to the interior threads 14 of said short axle tube. End portion 19 has a hexagonally-shaped exterior portion 24 and a circumferentially-extending exterior groove 25. Located between portion 24 and groove 25 is a cylindrical portion 26 that, in cross-section, has a circular outer periphery.

When the yo-yo is in an assembled condition, a conventional ball bearing unit 30 (also referred to herein as a ball bearing) will be located on tube 10 between the yo-yo's side portions. Unit 30 has an inner race 31, an outer race 32 and a plurality of balls 33 sandwiched between said races that enable the outer race to rotate relative to the inner race. Race 31 defines an aperture through which axle tube 10 extends.

Also placed on axle tube 10 are two stepped washers 34, one on each side of the ball bearing unit. Each washer has a thick inner portion 35 and a thin outer portion 36 located radially outwardly of portion 35. Axle tube 10 extends through a center-located aperture 37 in each washer.

A string-type tether 38 includes a loop portion 40 that encircles the ball bearing unit's outer race 32. The tether's distal end (not shown) will normally be tied to create a loop to enable a temporary securement of said end to one of a user's fingers.

Side portion 2 is an assemblage of parts and primarily includes a body member 42, a board assembly 43 having a circuit board 44, and a lens/cap 46. Axle tube 10 is preferably anchored to side portion 2.

Body member 42 is somewhat disk-shaped and is preferably made of a rigid, or substantially rigid, plastic material. Alternatively, the body member can be made of other materials, including metal, wood, rubber or be a composite or assemblage of rigid and/or non-rigid parts. The outer, thickened rim portion 48 of the body member forms the side portion's rim. Located at the center of the body member is a thru-bore 50. The body member has a substantially planar inwardly-facing surface 52 and an outwardly facing surface 54.

Surface 52 may also be referred to as a tether-facing surface since it faces said tether when said tether is taut and is extending outwardly from the axle structure in a direction perpendicular to the yo-yo's axis of rotation. It should be noted that one of the washers 34 and preferably a small portion of the ball bearing unit 30 are received within a circular cavity 56 located in the center of the body member's surface 52. The cavity has a larger diameter than the outer race of the ball bearing unit 30. When the yo-yo is in an assembled condition, the thick, center-located portion 35 of the washer contacts the inner race 31 of the ball bearing unit and the back surface 58 of the cavity 56. The ball bearing unit's outer race 32 does not contact the washer nor the body member and is therefore freely rotatable.

Located on surface 52 outwardly of cavity 56 is a ring-shaped circular cavity 60. Located within this cavity is a friction ring 62 that functions to facilitate an engagement between the yo-yo's tether and the body member when a user causes the yo-yo to return to his or her hand. The friction ring preferably has a relatively high-friction surface and is preferably made of a rubber or plastic material. Other known types of surface adaptations that facilitate tether engagement in yo-yos, such as a tapered surface, indentations, a starburst-shaped array of outwardly-extending ribs, spaced pads/protrusions, may also be simultaneously or alternatively employed on, or in, surface 52. Surface 52 may also alternatively not include an area adapted for tether engagement.

The body member's outwardly-facing surface 54 forms the bottom of a large, outwardly-facing cavity 64. The cavity has a circular sidewall 68. An outwardly-extending nipple portion 70 of the body member is located at the center of the cavity. It should be noted that the body member's thru-bore 50 extends through the center of portion 70.

The thru-bore 50 is configured to form a hexagonally-shaped cavity 72 at a location proximate the distal end 71 of the nipple portion 70. When the yo-yo is assembled, the hexagonally-shaped exterior portion 24 of axle tube 10 is non-rotatably received within said cavity.

Located in, or adjacent to, the circular sidewall 68 of the cavity 64 are four evenly-spaced-apart permanent magnets 74. As shown, the magnets are located in the body member's rim portion 48. In the drawings, said magnets are designated 74*a*, 74*b*, 74*c* and 74*d*. All of said magnets are preferably identical to each other, with the added alphanumeric portion of their designations providing a means to differentiate one from another in the drawing figures and the description.

Each magnet 74 is preferably non-movably secured within a groove/cavity 76 in sidewall 68 that is complementary in width to the magnet, but is preferably slightly longer than said magnet. Securement of the magnet within the groove/cavity is preferably accomplished through the use of an adhesive, fasteners and/or via a slight interference fit. Other conventional securement methods may alternatively be employed.

The magnets 74 may be any form of magnet, but are preferably of the rare earth permanent type. Preferably, each magnet is oriented whereby its South pole is located nearer to the yo-yo's axis of rotation than is the magnet's North pole. While four magnets are shown, there can alternatively be a greater or fewer number of magnets.

It should be noted that when the yo-yo is in an assembled condition, the cylindrical portion 26 of axle tube 10 extends outwardly from the distal end of the nipple portion 70. It is to this portion that the board assembly 43 is attached.

The board assembly 43 primarily includes the circuit board 44 and structure for rotatably connecting said board to the axle tube 10. The circuit board 44 may be considered a board member, is preferably in the shape of a truncated circle and includes an aperture 80. Said circuit board is preferably formed from a conventional circuit board material or from any other suitable rigid or semi-rigid material that may be modified to include electrically conductive areas that are capable of electrically linking the various electrical components of the powered rotation system. Alternatively, board 44 may be a simple support member in which the attached electrical components are connected together by wires.

Figure 6:
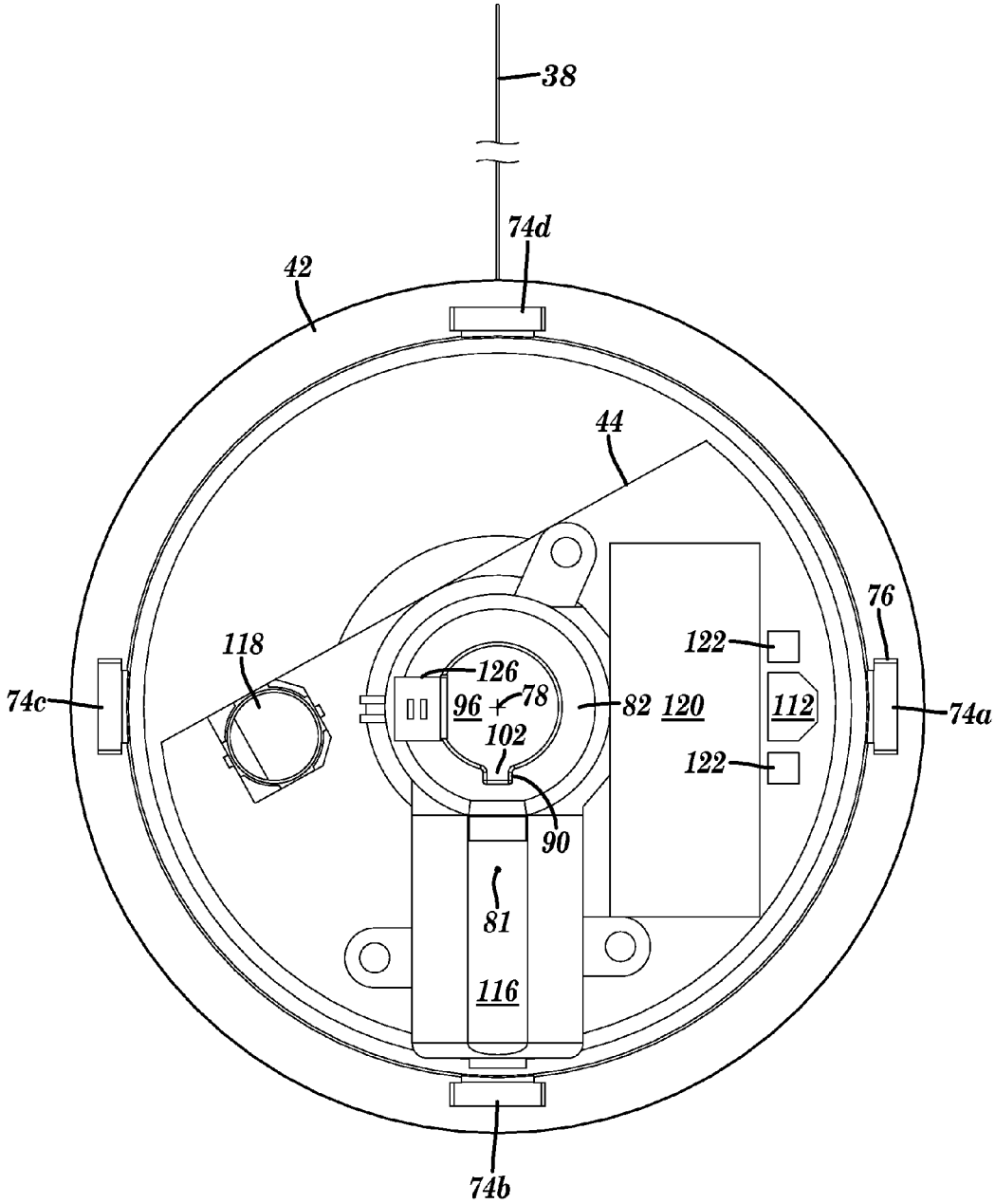
FIG. 6 is a side view of the yo-yo shown in FIG. 1 but shows the yo-yo with the lens removed.
Figure 7:
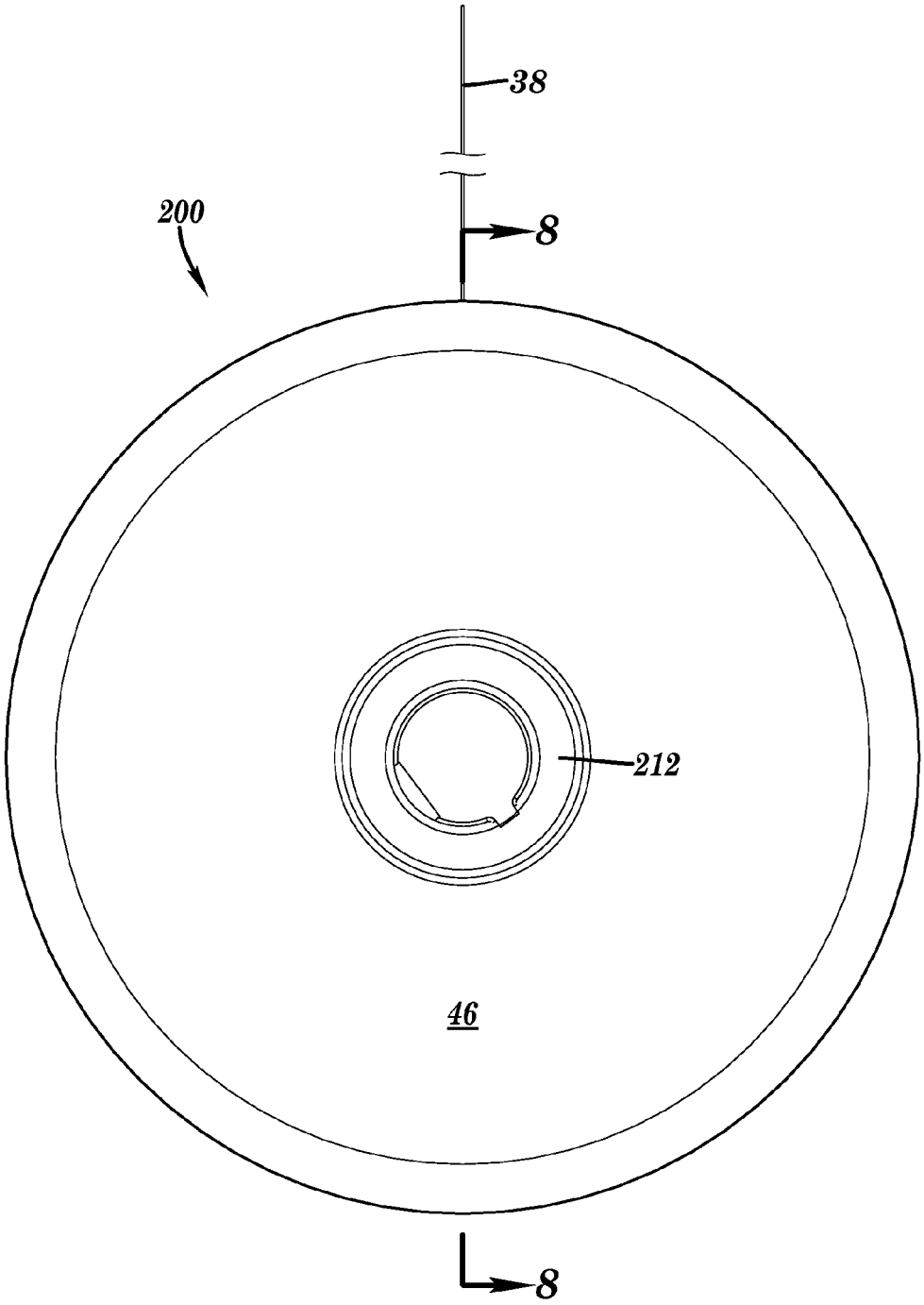
FIG. 7 is a side view of a second embodiment of a yo-yo in accordance with the invention.

One should note in FIG. 6 that the board assembly, including the circuit board 44 and all of the components mounted on said board, has a center of mass/gravity located at point 81. Also shown in the figure is the board assembly's center of rotation, the axis about which the board rotates, located at point 78. Point 78 is also preferably the center of aperture 80. One should note that point 78 is significantly offset from point 81 as a result of having the circuit board shaped non-symmetrically about aperture 80 and locating all the components mounted on said board at one end of said board. By maximizing the distance between the center of gravity 81 and the center of rotation 78, the force of gravity is used to maximum effect to cause the board to assume a substantially stationary position with point 81 directly below point 78 when the yo-yo is sleeping.

Securely affixed to the circuit board and centered on aperture 80 is a kinetic clamp 82. The kinetic clamp is a cylindrical member made of a rigid material, such as a hard plastic, and includes a center-located thru-bore 84. The thru-bore 84 is preferably co-linear with both the body member's thru-bore 50 and the center of aperture 80. The thru-bore 84 has a widened portion adjacent the circuit board in a manner whereby it forms a cavity 86 having a circular sidewall 87. At the opposite end of the clamp, the thru-bore includes a second widened portion that forms an open-ended cavity 88. The cavity 88 has a non-circular sidewall 89 that preferably includes a groove 90 and a 'U'-shaped slot 91.

When assembling side portion 2, a ball bearing unit 92, which is preferably identical to ball bearing unit 30, is placed onto portion 26 of axle tube 10 and is then releasably secured to said tube via the placement of a removable circlip 94 into groove 25. It should be noted that other securement methods may alternatively be employed to secure the ball bearing unit to the axle tube.

Once the ball bearing unit and circlip are in place on the axle tube, the circuit board is then rotatably secured to the axle tube by pressing the circuit board onto ball bearing unit 92 in a manner whereby the circlip fits into thru-bore 84 with some clearance while said ball bearing unit tightly fits within cavity 86 in the kinetic clamp to thereby become a portion of the board assembly 43. There is preferably a slight interference fit between the ball bearing unit's outer race and the interior sidewall 87 of the kinetic clamp's cavity 86. Preferably, cavity 86 is complementary in length to the ball bearing unit's outer race while the unit's inner race contacts tube 10 and the circlip but does not contact any portion of the circuit board. In this manner, once the kinetic clamp is pressed/pushed onto the ball bearing unit, the board assembly, including the circuit board, will be rotatably secured to axle tube 10, and thereby rotatably secured to side portion 2. It should be noted that any rotatable unit that enables relative rotation, such as a bushing or other types of bearings, can be used in place of ball bearing unit 92.

Removably located in the kinetic clamp's cavity 88 in a non-rotatable manner is a cap member 96. The cap member is preferably made of a plastic material and has a center-located bore 98 and an exterior sidewall 100. Said sidewall preferably has a projection 102 designed to fit within groove 90 in the cavity in the manner of a key fitting into a keyway to thereby prevent the cap from rotating once it is received within cavity 88. In this manner, the cap closes the open end of the cavity 88 and becomes a portion of the board assembly.

The cap's bore 98 is designed to inwardly receive an end portion 104 of an elongated rod member 106. The rod member is preferably made of a metal material, such as brass, steel or aluminum and has a second, opposite end portion 108. A non-round bore 110 extends through portion 108 and may extend the entire length of the rod member. The exterior surface of the rod member may have a shape similar to that of bore 110. While in the preferred embodiment the bore 110 is 'D'-shaped, a different non-round shape, such as square, rectangular or triangular, may alternatively be employed. The shape of bore 110 is designed so that when it inwardly receives a member having a complementary exterior shape, said member will be unable to rotate within said bore and preferably will fit in only a single orientation.

The rod member 106 is preferably permanently secured to the cap member via an interference fit between the outer surface of end portion 104 and the interior surface of the cap member's bore 98. Alternatively, end portion 104 may be secured to the cap member via other conventional securement methods including the use of an adhesive or via fastener(s).

Outwardly of the kinetic clamp on the circuit board 44 are a number of electrical components that, in combination with the permanent magnets 74 in the body member, create the side portion's powered rotation system. The major components on the circuit board include a sensor 112, a controller 114, an electromagnet 116, a capacitor 118 and a power source 120. The circuit board shown in the figures also includes two optional LED's 122 and a charging circuit 124. Electrically connected to the power source 120 and/or the charging circuit 124 is an electrical connector 126 that is preferably mounted in slot 91 in the kinetic clamp.

The sensor 112 is designed to be capable of detecting a magnetic field. In the preferred embodiment, the sensor is a Hall-effect sensor of a uni-polar type and switches "on" when it is exposed to a magnetic flux density that is greater than a predetermined amount. In the preferred embodiment, the sensor reacts to magnetic flux from a South pole of a magnet. It should be noted that the sensor 112 can alternatively be any device that can sense a nearby magnetic field, such as a Reed relay.

The sensor may be part of an integrated circuit package that may include an amplifier and/or switch and/or other components that enable a switching output to take place upon exposure to a magnetic field. Therefore, the sensor 112 is herein broadly defined to include the actual sensor and any other components that enable an electrical switching action when the sensor is exposed to a magnetic field of a polarity and strength to cause said switching action.

The controller 114 is electrically connected to the sensor. Preferably, said controller is a programmable microcontroller/microprocessor. The controller is preferably programmed to control the actuation of the electromagnet, including adding any required time delay, in response to the controller's receiving a signal from the sensor 112 that said sensor has been triggered by the passage of one of the magnets 74. While the controller is preferably a microcontroller, said controller may be any device, or a combination of devices, or a circuit having various electrical devices/components, that will receive a signal from the sensor or note a change in the sensor and then cause the actuation of the electromagnet while adding a timing delay, if required.

An electromagnet 116 and capacitor 118 are also located on the circuit board and electrically connected to the controller. The electromagnet is preferably simple in design, located proximate a side edge of the circuit board and is capable of being temporarily electrically energized by electricity from said capacitor due to an action of the controller. It should be noted that locating the electromagnet proximate a side edge of the circuit board facilitates the electromagnet being able to apply a force to one of the permanent magnets 74 located in the side portion's body member.

Power source 120 is shown in many of the figures as being located on the circuit board, preferably adjacent the sensor. The power source is preferably a battery and provides electrical power to the sensor, controller, and to the electromagnet via the capacitor. In the preferred embodiment, said battery is a rechargeable unit and is preferably at least substantially made from materials that are not affected by a magnet.

It should be noted that the controller can preferably recognize a condition whereby it can transition the powered rotation system to a low-power mode when the sensor is not being triggered on a regular basis by the passing of one of the permanent magnets. In said low power mode in which no power is being sent to the electromagnet, the electricity consumed by the powered rotation system will be minimized to a near zero amount. Furthermore, the use of a programmable controller as the controller for the system enables a user to change the speed at which the yo-yo will rotate when the yo-yo reaches its steady state operating condition by downloading different operating instructions to the controller, preferably via connector 126. It should be noted that a steady state operating condition or steady state speed is herein defined as a condition wherein a portion of the yo-yo is continuously rotating at a speed within a predetermined range of speeds programmed into the controller.

Also located on the circuit board are two optional LED's 122. It should be noted that a greater or fewer number of LED's may be employed. Furthermore, other types of lighting devices may be used in place of one or more of the LED's. Preferably, LED's 122 are capable of providing multiple different colors of light.

As a convenience to the user, the circuit board also preferably includes a charging circuit 124 electrically connected to the power source 120. The charging circuit is shown in a generalized form since any type of conventional charging circuit capable of charging the power source 120 may be employed. To provide a means to receive electrical power from an exterior power source, such as a battery pack, an adaptor or a USB cable, the charging circuit is preferably electrically connected to the electrical connector 126 located in the kinetic clamp's slot 91. Alternatively, the power source 120 may be connected directly to the connector 126 and the charging circuit may be located on an exterior device that is temporarily connected to the connector 126 for charging said power source 120.

Figure 11:
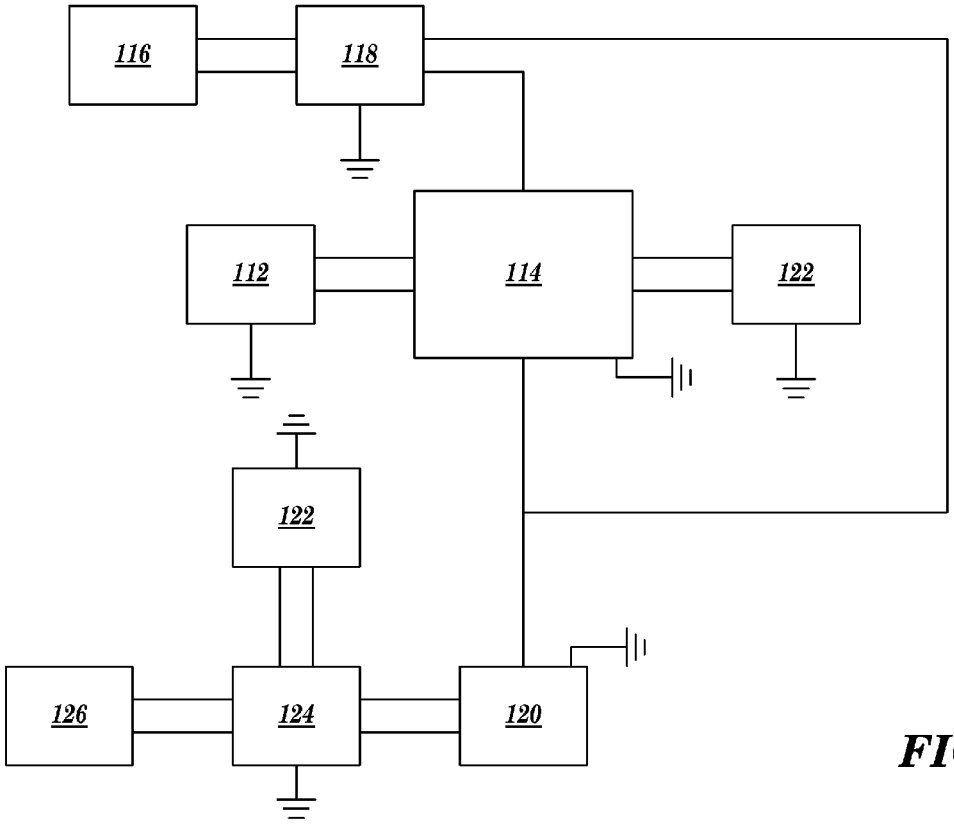
FIG. 11 is a generalized diagram of the interconnections between the electrical components of a powered rotation system for a yo-yo in accordance with the invention.

A generalized box-type diagram for the electrical components/circuits secured to the board assembly 43 is provided in FIG. 11. It should be noted that while not shown, the powered rotation system may include various other electrical components normally employed to direct and control the flow of electricity.

A round cap in the form of lens 46 fits over the body member's cavity 64. Preferably, the lens includes a center-located aperture 130 through which the distal end of the kinetic clamp extends. Said distal end of said clamp preferably includes connector 126 which is thereby accessible to a user.

The lens 46 is preferably made of a plastic material and is initially secured to the body member via a plurality of peripherally-located tabs 132 that are received into the top of the grooves 76 located in the sidewall 68 of the body member. Preferably, once the lens is fit to the body member, it will be permanently secured to the body member by the further action of sonic welding the lens to said body member. Other well-known conventional releasable or permanent securement methods may be employed to secure the lens to the body member, such as adhesives and/or fasteners. If the LED's are to be viewable by a user, the lens would be made of a transparent material.

Side portion 4 of yo-yo 1 is in most ways identical to side portion 2 and preferably includes the same type of electrically-powered rotation system. Both side portions include an identical lens 46, circuit board 44, ball bearing unit 92 and body member 42 that has a plurality of permanent magnets 74. Since side portion 4 has a weight substantially equal to that of side portion 2, the yo-yo 1 will have a balanced weight distribution whereby it will not tend to lean off-center when it is sleeping at the end of its tether.

However, there are some significant differences between side portions 2 and 4. In side portion 4, the short axle tube 8 is anchored to the body member. Furthermore, side portion 4 has a rotatable board assembly 140 that differs from board assembly 43 by having a slightly different cap member 142 secured to the kinetic clamp, and a slightly different rod member 144 secured to said cap member 142.

As shown, the hexagonal exterior portion 15 of axle tube 8 fits into the hexagonal cavity 72 in the body member's nipple portion, leaving the tube's cylindrical portion 17 extending outwardly from said nipple portion. As in the other side portion, once the bearing unit 92 is on the tube's portion 15, a circlip 94 is fitted into the tube's groove 16 to secure the ball bearing unit to the axle tube. Unit 92 is then received within the circuit board's clamp 82 to thereby secure the board assembly 140 onto tube 8.

Cap member 142 is outwardly identical to cap member 96 of side portion 2. However, cap member 142 includes a center-located bore 146 that may be a slightly different size than bore 98 in cap member 96. Bore 146 is of a size and shape whereby a first end portion 150 of rod member 144 is preferably permanently secured within said bore.

Rod member 144 has a second end portion 152 that is sized and shaped to be complementary to, and slide into, bore 110 of rod member 106 in a manner whereby rod member 144 cannot rotate relative to rod member 106. Rod member 144 is thereby rotationally locked to rod member 106 whereby should rod member 106 rotate, rod member 144 will similarly rotate. However, bore 110 may be round or some other shape if some other means for preventing relative rotation, such as a fastener, is employed to lockably connect the two rod members.

Preferably, a user will assemble each of the yo-yo's side portions separately. When side portion 2 is fully assembled but separated from a fully assembled side portion 4, rod member 106 will preferably be fully received within tube 10. Rod member 144 will preferably extend outwardly from tube 8 by a small distance to facilitate assembly, but preferably does not extend outwardly past a plane formed by the associated body member's surface 52. The user can then assemble the yo-yo by initially moving the yo-yo side portions together while positioning the circuit boards so that they line up with each other. One should note that until the rod members 106 and 144 engage each other, a user can position a side portion's circuit board by rotating the portion of the kinetic clamp that extends outwardly from the aperture 130 in that side portion's lens. Next, the user slides the end portion 152 of rod member 144 into the end portion 108 of rod member 106 and moves the side portions together until the end of tube 10 engages the end of tube 8. The user can then secure together the two side portions by rotating the body member of one side portion relative to the body member of the other side portion in a manner whereby the exterior threads 22 of tube 10 engage the interior threads 14 of tube 8. The user continues the relative rotation of the body members until the yo-yo is securely assembled. The user can then place the tether onto the yo-yo's center-located ball bearing unit 30 and thereby complete the assembly procedure.

Figure 5:
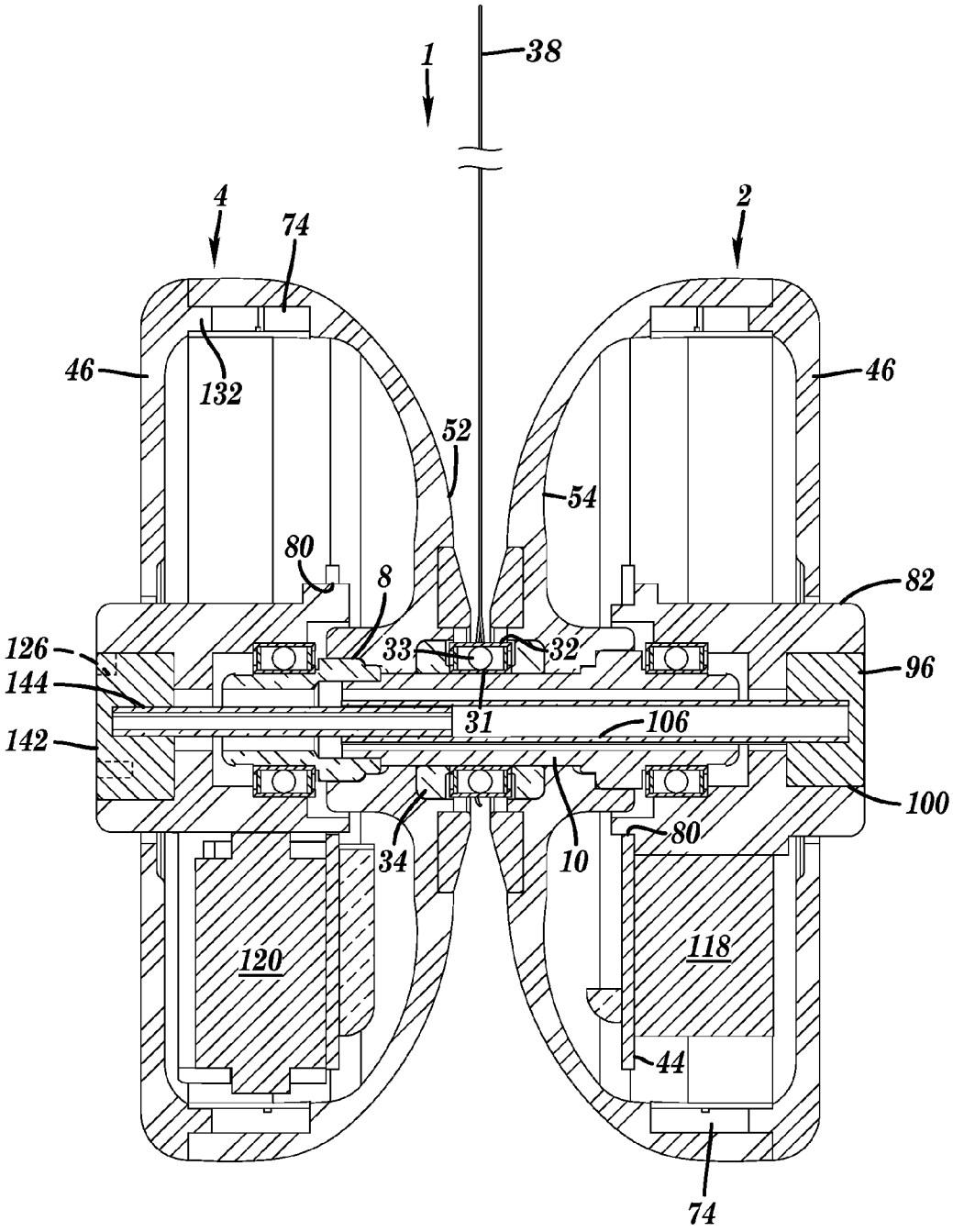
FIG. 5 is a cross-sectional view of the yo-yo shown in FIG. 1, taken at the plane labeled 5-5 in FIG. 2.

FIG. 5 provides a cross-sectional view of the yo-yo 1 when said yo-yo is in an assembled condition. One should note that once the two rod members 106 and 144 engage each other, they combine to form a single rod (herein also referred to as a rod unit/rod assembly) that rotationally locks together board assembly 43 of side portion 2 to board assembly 140 of side portion 4. It should be noted that as an alternative, said rod may be in the form of a single rod member that extends between the cap members 96 and 142 wherein said rod member may be permanently or releasably secured to one of said cap members and releasably secured to the other cap member. Preferably, once the yo-yo is assembled, the circuit boards of both board assemblies will be directly opposed to each other so that as the force of gravity acts on both circuit boards, both board assemblies will thereby be biased to assume the same position whereby each board assembly's center of mass will be located below the yo-yo's axis of rotation when the yo-yo is vertically oriented.

Figure 8:
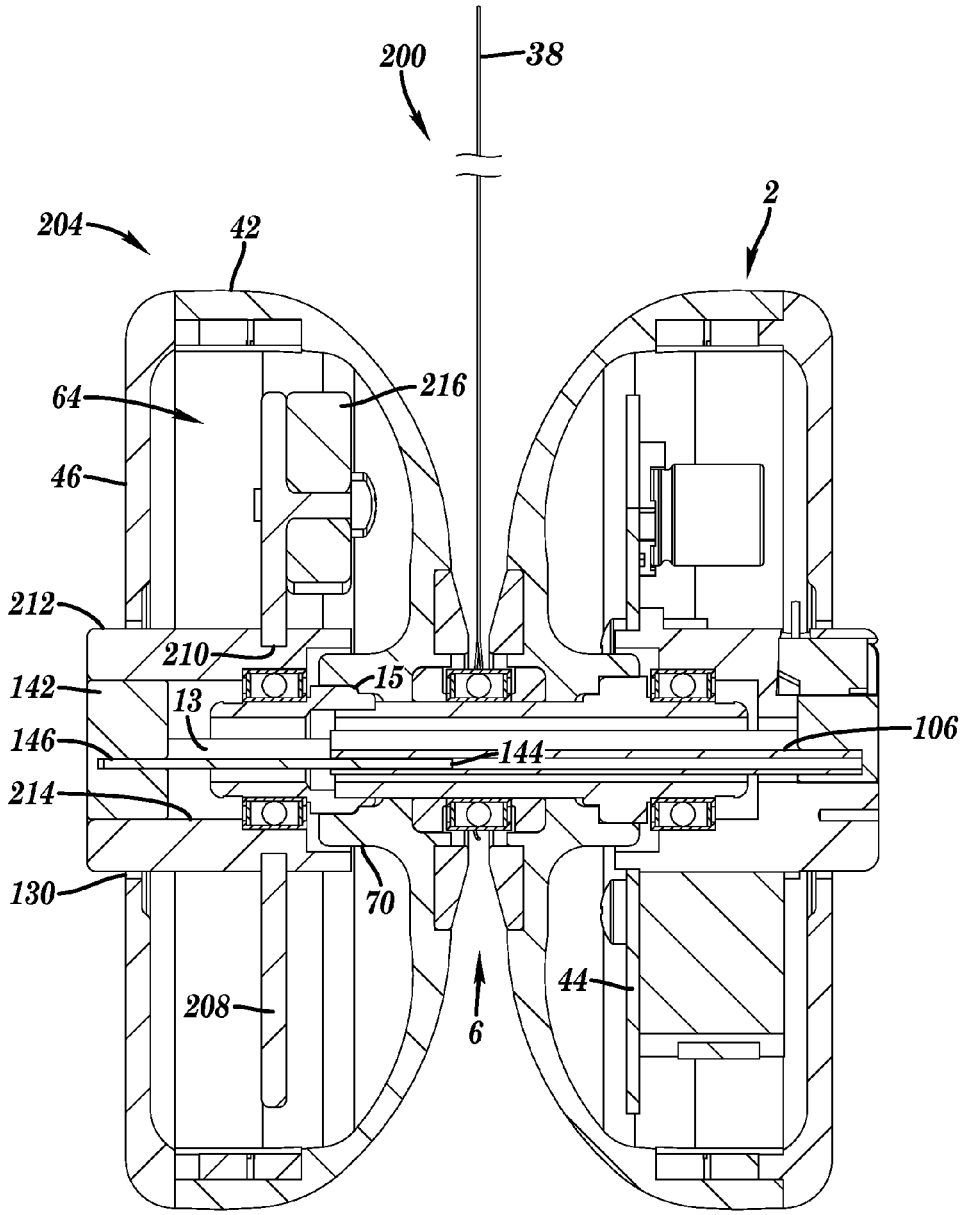
FIG. 8 is a cross-sectional view of the yo-yo shown in FIG. 7, taken at the plane labeled 8-8 in FIG. 7.
Figure 9:
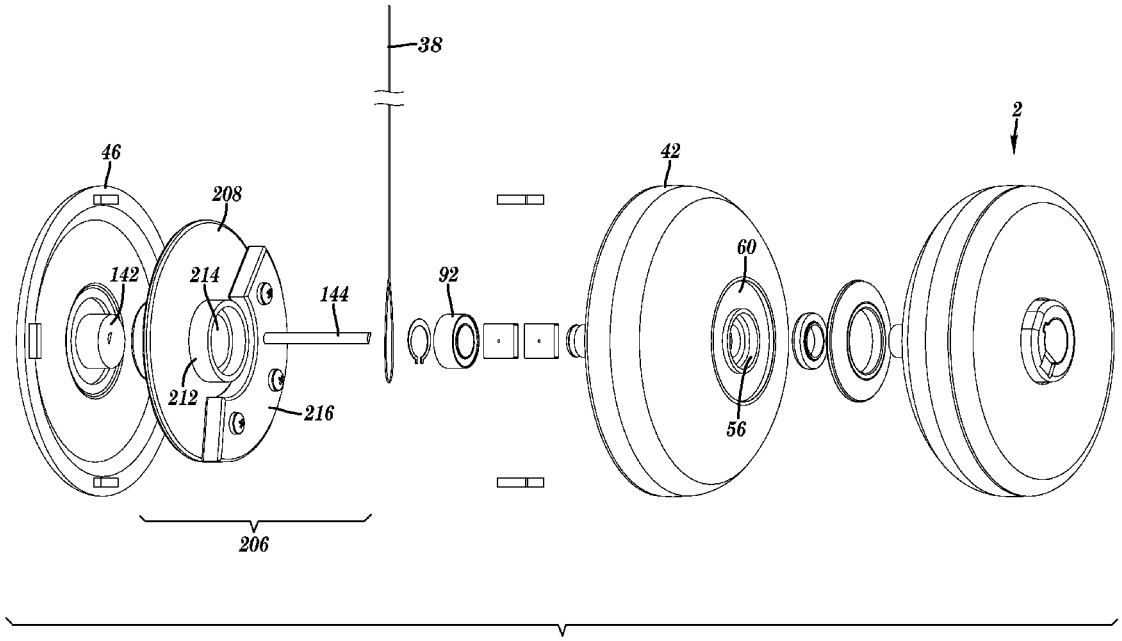
FIG. 9 is a front perspective view of the yo-yo shown in FIG. 7, with the left side of the yo-yo shown in exploded fashion.
Figure 10:
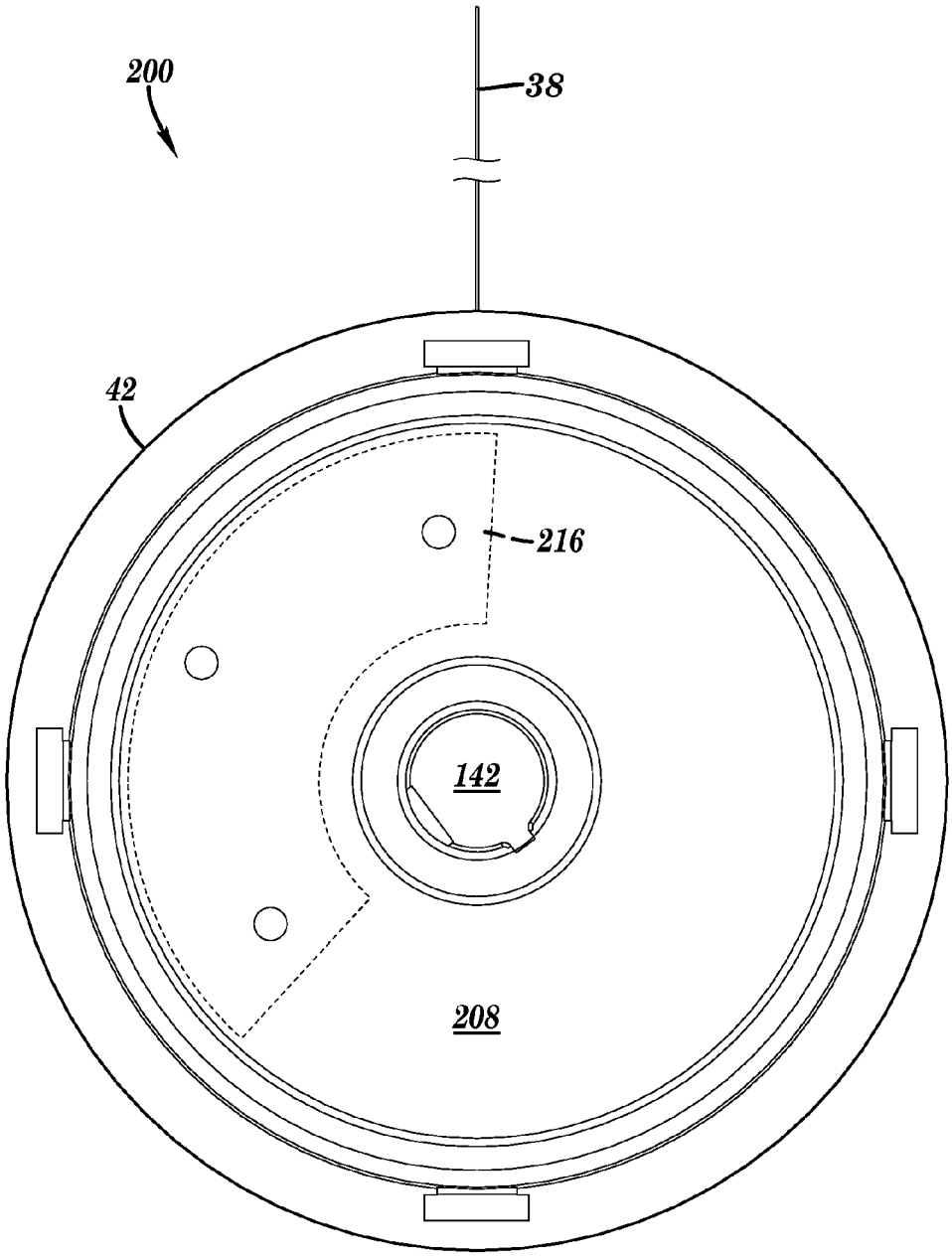
FIG. 10 is a side view similar to FIG. 7 but shows the same yo-yo with the lens removed.

FIG. 8 provides a cross-sectional view of a second embodiment of a yo-yo 200 in accordance with the invention. Yo-yo 200 includes an axle structure 6 that is identical to that used in yo-yo 1, and first and second side portions, 2 and 204, respectively. Side portion 2 is structurally and functionally identical to side portion 2 of yo-yo 1 and thereby includes an identically powered rotation system.

Side portion 204 comprises a body member 42, a weighted rotatable board assembly 206 and a lens 46. Preferably, the outward appearance of side portion 204 is identical to that of side portion 2.

Body member 42 of side portion 204 is preferably identical to body member 42 of side portion 2 and similarly includes a cavity 56 for a washer 34, a cavity 60 for a friction ring 62, an outwardly-facing cavity 64 and a nipple portion 70. Located in the nipple portion's cavity 72 is portion 15 of an axle tube 8.

Board assembly 206 includes a board member 208 that is located in the body member's cavity 64. Said board member has an aperture 210 and a kinetic clamp 212 secured to said board member in a manner whereby a thru-bore 214 of said clamp is collinear with said aperture. Clamp 212 is preferably substantially identical to clamp 82 of side portion 2 and includes a bearing 92 located on tube 8 to rotatably secure assembly 206 to the yo-yo.

Also secured to the board member is a weight member 216. Said weight member is preferably made of a metal material and has a weight whereby the weight of side portion 204 will substantially equal that of side portion 2. It should be noted that while board assembly 206 includes a board member with an attached weight, said weight itself may take the form of the board member and/or itself be considered the board member.

As in side portion 4 of yo-yo 1, side portion 204 has a cap member 142 that is non-rotatably secured to the clamp 212 in a manner whereby a shaped rod member 144 that is fixedly secured to a bore 146 in the cap member extends through the board member's aperture 210 and extends into the thru-bore 13 of axle tube 8.

Lens 46 functions to cover cavity 64 and may be permanently or releasably secured to body member 42 in the same manner as employed in side portion 2. Preferably, the distal end of the kinetic clamp 212 extends through the lens' aperture 130.

Assembly of yo-yo 200 is substantially the same as with yo-yo 1. Preferably, engagement of the two rod members will result in board member 208 being aligned with, and connected to, the circuit board 44 of board assembly 43. In this manner, the mass of assembly 206 is added to the mass of assembly 43. Each of the board assemblies, 43 and 206, has a center of mass. Upon assembly of the yo-yo, said centers of mass will preferably be substantially collinear.

Figure 12:
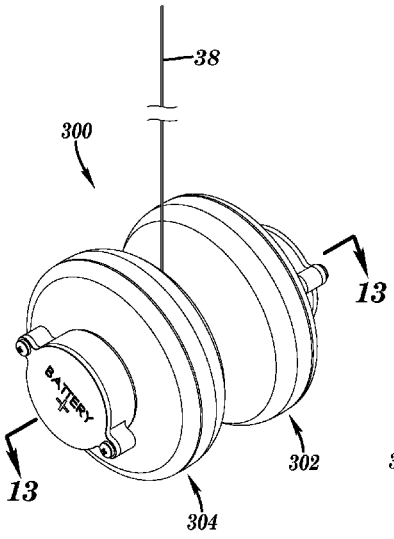
FIG. 12 provides a perspective view of a third embodiment of a yo-yo in accordance with the invention.
Figure 13:
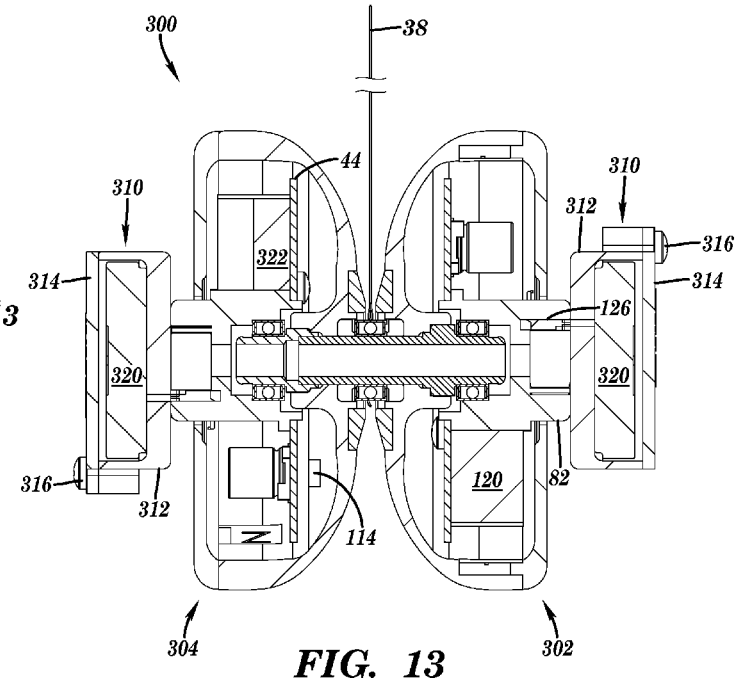
FIG. 13 is a cross-sectional view of the yo-yo shown in FIG. 12 taken at the plane labeled 13-13 in FIG. 12.

FIGS. 12 and 13 show a third embodiment of the invention. In the figures, yo-yo 300 has first and second side portions, 302 and 304 respectively. The yo-yo has an axle structure identical to that employed in the previous embodiments.

Side portion 302 is identical to side portion 2 except that it includes a battery case 310 secured to the end of the kinetic clamp 82. The case includes a base portion 312 attached to the clamp by either a standard or quick-release fastener (not shown), and a cover portion 314 releasably secured to said base portion by a pair of screw-type fasteners 316. Removably located within the battery case is a button-type battery 320. Located in the case are electrical leads (not shown) that electrically connect the battery to the side portion's electrical connector 126 and thereby to the power source 120. In this manner, said battery 320 can act as a booster to power source 120, thereby either increasing the total power available and/or providing an energy boost should source 120 become depleted. It should be noted that said case and battery may be replaced by a battery adapted for securement to clamp 82 and connector 126.

Side portion 304 is identical to side portion 4 except that it features a weight member 322 located on the circuit board 44 in lieu of power source 120, and a battery case 310 secured to the end of the kinetic clamp 82. The case includes a base portion 312 and a cover portion 314 releasably secured to said base portion by a pair of screw-type fasteners 316. Removably located within the battery case is a button-type battery 320. Located in the case are electrical leads (not shown) that electrically connect the battery to the side portion's electrical connector 126 and thereby to the controller 114 and other electrical components located on the circuit board 44. In this manner, battery 320 effectively acts as the power source for the side portion's powered rotation system. The weight member 322 is optional but is employed so that the yo-yo's two side portions will be similar in weight and also to increase the mass secured to the circuit board 44 of side portion 304. In this manner, the powered rotation system of side portion 304 is powered by an easily replaceable battery. It should be noted that while the two side portions use battery 320 in different ways, it is within the scope of the invention that a battery 320 can be used in either of a yo-yo's side portions as either a booster for power source 120 or as a replacement for power source 120.

The operation of the powered rotation system located in side portion 2 of yo-yo 1 will now be described. The yo-yo's other powered rotation system located in side portion 4, as well as the powered rotation system employed in side portion 2 of yo-yo 200 and the side portions of yo-yo 300, operate in the same manner.

When the rotation system is operating and the yo-yo is sleeping at the end of the tether and is vertically oriented, the board assembly 43 will tend to become stationary with its center of mass located below the yo-yo's axis of rotation. This occurs since the board assembly is freely rotatable relative to the body member and since the center of mass (also the center of gravity) of the board assembly is not collinear with the yo-yo's axis of rotation. Since the body is rotating, there will be relative rotation between the body member and the relatively stationary circuit board whereby the permanent magnets 74 in the body member move past the sensor 112.

When yo-yo 1 is sleeping at the end of the tether and the body member 42 is rotating in a clockwise direction relative to circuit board 44, FIG. 6 can represent a snapshot of the spinning yo-yo. At the point in time shown in the figure, magnet 74*a* has just moved to a point where it is directly across from the sensor 112. The distance/gap between the sensor and any adjacent magnet 74 will preferably be relatively small, typically about 0.2 to 0.4 inches. The size of the gap can be outside of that range depending on such factors as the strength of the magnets 74 and on the sensitivity of the sensor 112. At the position shown, the magnetic flux from magnet 74*a* has already triggered the sensor (the sensor was triggered as the magnet moved into the range of detection of the sensor, approximately a few degrees prior to the point shown) whereby the sensor has outputted a signal, either a discrete signal or a change in the sensor detectable by the controller, to the controller 114.

The controller has preferably already determined the rotational speed of the body member by counting the number of signals it receives from the sensor per period of time. As long as said speed is within a predetermined range of speeds set by the instructions previously programmed into the controller, 4000 RPM to 5500 RPM for example, the controller will cause the actuation of the electromagnet 116 via the capacitor 118. Based on the calculated rotational speed of the body member and preprogrammed information relative to the spacing between the magnets 74, the controller determines the proper timing for when to cause the initially charged capacitor to send electricity to the electromagnet so that the electromagnet will generate a magnetic flux/force that acts on magnet 74*b*. Said force will preferably start at the point shown where the magnet and electromagnet are center-to-center (directly across from each other) and reaches a maximum a few degrees of rotation after said center-to-center point has been passed.

Preferably, upon actuation, the end of the electromagnet will be a South pole, while the fixed magnets 74 are oriented whereby each magnet's South pole is located nearer to the yo-yo's axis of rotation than is its North pole. As a result, the actuated electromagnet will apply a pushing force on each permanent magnet just as each permanent magnet 74 goes past the electromagnet. Said force continues until the controller causes the flow of electricity from the capacitor to stop. The pushing force on each permanent magnet 74 thereby acts to increase, or at least maintain, the body member's rotational momentum to thereby prolong the yo-yo's sleep time. Since the electromagnet is actuated only when a magnet 74 goes past the electromagnet, maximum efficiency is realized since said electromagnet will not be actuated long enough to inadvertently repel a magnet 74 approaching the electromagnet. It should be noted that the system makes use of the entire weight of the board assembly and any other structures connected to, and rotatable with, said board assembly as a mass that the electromagnet can push against as it applies a repulsive force to each permanent magnet. The large combined mass allows said application of force without causing a large degree of movement of the assembly 43.

As the yo-yo continues to sleep with the body member 42 moving in a clockwise direction from the position shown in FIG. 6, the body member moves to a point where the magnet 74*a* is past the sensor 112 a sufficient distance whereby the sensor switches to its "off" condition, which is transmitted to the controller. The controller stops the flow of electricity to the electromagnet from the capacitor 118 and allows said capacitor to recharge from the power source 120. It should be noted that the charging cycle will continue until the next permanent magnet, magnet 74*d*, approaches the sensor, thereby maximizing the charging time for the capacitor. This enables the capacitor to be charged with a minimum drain rate from the battery, which maximizes battery life.

Once the approaching magnet 74*d* causes the sensor to send a signal to the controller, the described actuation of the electromagnet is repeated. The same process occurs with the passage of each magnet 74 past the sensor whereby the yo-yo will continue to sleep until the battery runs out of power or the user stops the rotation of the yo-yo.

Unlike the yo-yo taught in our U.S. Pat. No. 7,448,934, the yo-yo 1 described herein connects, via rod members 106 and 144, the board assembly 43 in side portion 2 to the board assembly 140 in side portion 4. As a result, both board assemblies move, or don't move, in tandem and are freely rotatable relative to the yo-yo's body members.

By connecting together the yo-yo's two board assemblies, the effective weight that each assembly's electromagnet 116 has to use when it pushes against one of the permanent magnets 74 is potentially doubled. One should note that the electromagnet is located off-center on the circuit board 44. As a result, when the yo-yo is assembled whereby the circuit boards are aligned, the longitudinal axis of each circuit board's electromagnet will be pointing in a slightly different direction. When the body members are positioned so that their permanent magnets are aligned, the electromagnets will be actuated at different times. As a result, each electromagnet has double the weight to push against when it is applying a force to a permanent magnet. This greatly increases the efficiency of the powered rotation systems by increasing the stability of the yo-yo's circuit boards. The effective increased mass that an electromagnet has to push against translates to a smaller rocking motion of the circuit board since said motion (distance the board moves) is directly proportional to the mass. The reduced rocking enables the controller to more precisely achieve the proper timing for actuating the electromagnet to cause the most effective and efficient application of force to a passing permanent magnet.

Concerning the operation of yo-yo 200, its powered rotation system housed in side portion 2 functions in the same manner as previously described. However, to increase efficiency, the board assembly 43 of side portion 2 is connected to the rotatable board assembly 206 in side portion 204 by the rod members. In this manner, whenever electromagnet 116 is actuated, it pushes against the combined mass of its associated board assembly 43 and the mass of board assembly 206. In this manner, the circuit board 44 will be biased to move as little as possible, thereby maximizing efficiency by enabling the controller to better determine the proper time to actuate the electromagnet.

Each of the optional lights 122 is preferably an LED (light emitting diode) and can preferably generate light in two different colors, such as yellow and green. Per FIG. 11, one of said lights is connected to the controller and functions to indicate to the user when the rotation system is operating and when the yo-yo has reached a steady state speed. Preferably, the other of said lights is connected to the charging circuit 124 in a manner whereby it functions to indicate to the user when the power source 120 is depleted and/or when charging is in-progress.

The optional charging circuit 124 is used for recharging the power source 120 from a remote power source, such as a battery pack, a USB cable or an adapter that is operatively connected to a source of electricity. In an alternate method of use, once the charging circuit is connected to a remote power source, a user can hold the yo-yo with a finger on the end of each of the kinetic clamps and then spin the yo-yo. The powered rotation system will then cause the yo-yo's body members to rotate and be powered, in effect, by the remote power system.

It should be noted that a simpler circuit can be employed in the powered rotation system whereby the capacitor 118 is not employed and the electromagnet 116 is directly caused to be energized by an output from the sensor 112, or by an output from an integrated circuit that includes the sensor, or by the controller 114. Other variations to the system shown in FIG. 11 may be alternatively employed to achieve substantially the same results.

It should further be noted that while magnets 74 can affect the sensor 112 and be affected by the electromagnet 116, different members can be employed in place of the magnets 74 as long as whatever sensor is employed as sensor 112 can be affected by the passage of said members and said electromagnet can affect said members, or other members, located in the body member. While multiple magnets 74 are preferred, the body member may feature just a single magnet 74.

It should also be noted that the system disclosed herein for connecting together a yo-yo's two board assemblies can be used with other types of powered rotation systems for yo-yos. For example, the powered rotation systems we teach in our pending U.S. patent application Ser. No. 12/266,172, herein incorporated by reference, employs a circuit board that features a light emitter, a light-sensitive sensor and a plurality of reflective, magnetically-affectable metal members secured in the adjacent body member. In that type of system, one can link together the yo-yo's two circuit boards to similarly enhance the efficiency of the powered rotation system(s).

In addition, a powered rotation system in accordance with the invention will maintain the rotation of the yo-yo's body member no matter which direction, clockwise or counterclockwise, said body member is rotating. This occurs since the electromagnet is caused to be actuated when a magnet 74 is directly across from said electromagnet, and therefore will apply the same force to the body member irrespective of the direction in which the body member is rotating.

The structure of the yo-yo taught herein also offers an additional method of play whereby a user can hold the yo-yo via the cap members 96 and 142 of the yo-yo's kinetic clamps. This can be done while the yo-yo is sleeping, or when the user initially starts the yo-yo's body members rotating.

The yo-yo side portions taught herein can have other forms, or shapes, than those shown. Furthermore, the axle structure may be formed of other components than the ones shown in the figures.

It should be noted that if the circuit/controller creates a significant delay between when the sensor is triggered and when the electromagnet is actuated, the portion of the body member that triggered the sensor can also be employed as the magnet-affectable member. A magnet-affectable member is herein defined as a member that can be attracted to, or repulsed by, a magnetic field.

The preferred embodiments of the invention disclosed herein have been discussed for the purpose of familiarizing the reader with the novel aspects of the invention. Although preferred embodiments of the invention have been shown and described, many changes, modifications and substitutions may be made by one having ordinary skill in the art without necessarily departing from the spirit and scope of the invention as described in the following claims.

We claim:

1. A yo-yo comprising:

first and second body members;

first and second board assemblies, wherein said first board assembly has mass and wherein said second board assembly has mass;

wherein a first side portion of said yo-yo comprises said first body member, said first board assembly and a plurality of permanent magnets fixedly secured to said first body member in a manner wherein said permanent magnets are spaced apart from each other;

wherein a second side portion of said yo-yo comprises said second body member and said second board assembly;

wherein said first and second side portions are secured together in a spaced-apart relation by an axle structure;

a tether operatively connected to said axle structure;

wherein said first board assembly is rotatably secured to said yo-yo in a manner whereby said first board assembly is freely rotatable relative to said first body member, wherein a sensor, an electromagnet, a controller and an electrical power source are secured to said first board assembly and are operatively connected to each other;

wherein said sensor is capable of detecting a magnetic field and wherein said permanent magnets and said sensor are located in a manner whereby when said first body member is rotating relative to said first board assembly, said permanent magnets are capable of passing said sensor in a manner that causes a change in said sensor;

wherein said electromagnet is located in a manner whereby when said first body member is rotating relative to said first board assembly and said electromagnet receives power, said electromagnet can apply a force to one of said permanent magnets located proximate said electromagnet;

wherein when power is being supplied to said sensor and said permanent magnets are passing by said sensor and causing a change in said sensor that is transmitted to said controller, said controller can cause said electromagnet to become temporarily energized at an appropriate time to cause said electromagnet to apply a force to one of said permanent magnets in a manner whereby said force acts to at least maintain a rotational momentum of said body member;

wherein said second board assembly is rotatably secured to said yo-yo in a manner whereby said second board assembly is freely rotatable relative to said second body member; and wherein a rod connects together said first and second board assemblies, wherein said rod and said axle structure are relatively rotatable, and wherein said rod also functions to cause said board assemblies to become positionally fixed relative to each other and wherein when the first board assembly's electromagnet applies a force to one of said permanent magnets, an equal and opposite force will be created and will try to cause a movement of said first board assembly that may be mitigated by the rod enabling the mass associated with said second board assembly to be added to the mass associated with the first board assembly.

2. The yo-yo of claim 1 wherein said rod extends through a bore in said axle structure.

3. The yo-yo of claim 1 wherein said rod is fashioned from first and second rod members.

4. The yo-yo of claim 1 wherein said rod is a telescoping rod comprising first and second rod members that are telescopically engaged.

5. The yo-yo of claim 4 wherein an exterior surface of said first rod member, when seen in a cross-section oriented perpendicular to a longitudinal axis of said first rod member, has a non-circular shape.

6. The yo-yo of claim 4 wherein an end portion of said first rod member is designed to slidably fit within an end portion of said second rod member, and wherein said exterior surface of said first rod member, when seen in said cross-section, has a shape whereby there is only one orientation in which said first rod member will slide within said second rod member.

7. The yo-yo of claim 6 wherein an exterior surface of said first rod member, when seen in a cross-section oriented perpendicular to a longitudinal axis of said first rod member, is in the shape of a 'D'.

8. The yo-yo of claim 1 wherein a weight member is secured to said second board assembly and has a weight whereby the yo-yo's first and second side portions are substantially equal in weight.

9. The yo-yo of claim 1 wherein the first board assembly includes a cylindrical member having a thru-bore into which is located a bearing unit that is connected to a portion of said axle structure and which enables the first board assembly to be rotatable relative to the first body member.

10. The yo-yo of claim 1 wherein a capacitor is operatively connected to said controller, is secured to said first board assembly, can be charged by said power source and can send a pulse of electricity to said electromagnet.

11. The yo-yo of claim 1 wherein a light is secured to said first board assembly and is operatively connected to said controller and to said power source whereby said controller can cause said light to be energized to indicate that the first body member is rotating at a speed within a predetermined range of speeds.

12. The yo-yo of claim 1 wherein said axle structure includes a first axle tube and a second axle tube, wherein an end portion of said first axle tube is adapted to fit within and engage a portion of said second axle tube, and wherein said rod extends through both of said axle tubes.

13. The yo-yo of claim 12 wherein said rod comprises a first rod member and a second rod member, wherein an end portion of said first rod member is designed to slidably fit within an end portion of said second rod member, wherein the end portion of one of said rod members is completely located within one of said axle tubes, and wherein the end portion of the other of said rod members protrudes from the other of said axle tubes.

14. The yo-yo of claim 1 wherein said controller is adapted to be programmable.

15. The yo-yo of claim 1 wherein said second side portion is substantially identical to said first side portion and includes a plurality of permanent magnets fixedly secured to said second body member in a manner wherein said permanent magnets are spaced apart from each other, and wherein a sensor and an electromagnet are secured to said second board assembly and are operatively connected to a controller and to a power source.

16. The yo-yo of claim 15 wherein the first board assembly's electromagnet will be actuated at a different time than the second board assembly's electromagnet to thereby maximize the resistance to movement of the first board assembly when the first board assembly's electromagnet is actuated and applies force to one of said permanent magnets.

17. An improved yo-yo of the type having first and second side portions connected together by a central axle structure, wherein said first side portion has a body member and a board member, wherein said board member has mass and is freely rotatable relative to said body member, wherein an electrically-powered apparatus is at least partially located on said board member, wherein when said body member is rotating relative to said board member, said apparatus can apply force to said body member that acts to at least maintain the rotation of said body member, said improvement comprising:

a rod structure that connects said board member to a member located in said second side portion, wherein said member located in said second side portion has mass and is freely rotatable relative to said body member, wherein said rod structure and said central axle structure are relatively rotatable, wherein said rod structure causes said board member and said member located in said second side portion to be positionally fixed relative to each other, and wherein when the apparatus applies a force to said body member, an equal and opposite force will be created and will try to cause a movement of said board member that may be mitigated by said rod structure enabling the mass of said member located in said second side portion to be added to the mass of said board member.

18. A yo-yo comprising:

first and second side portions secured together in a spaced-apart relation by an axle structure;

a tether operatively connected to said axle structure;

wherein said first side portion comprises a body member and a freely rotatable board assembly;

wherein located on said board assembly are a sensor, an electromagnet, a controller operatively connected to said sensor and said electromagnet, and an electrical power source operatively connected to said sensor, electromagnet, and controller;

wherein at least one permanent magnet is fixedly secured to said body member and is positioned to pass adjacent said sensor when said body member is rotating relative to said board assembly and wherein said sensor is of a type whereby said sensor will be affected when said permanent magnet passes adjacent said sensor;

wherein when said body member is rotating relative to said board assembly and said sensor is being affected by the passage of said at least one permanent magnet, whenever said electromagnet is actuated, one of said at least one permanent magnets will be located proximate said electromagnet and a pole of said electromagnet will have the same polarity as a pole of the permanent magnet adjacent said electromagnet whereby said electromagnet will only apply a repulsive force on said adjacent permanent magnet in a manner that helps to maintain a rotational momentum of said body member;

wherein said second side portion comprises a second body member and a second board assembly, wherein a sensor and an electromagnet are secured to said second board assembly and are operatively connected to a controller and to a power source, wherein said second body member has at least one permanent magnet fixedly secured to it and positioned whereby it can be located proximate the second board assembly's electromagnet and acted upon by the second board assembly's electromagnet to maintain a rotational momentum of the second body member;

wherein connecting structure connects together said first and second board assemblies in a manner whereby said first and second board assemblies become positionally fixed relative to each other, and wherein said axle structure can rotate relative to said connecting structure; and wherein when the first board assembly's electromagnet applies a force to one of said permanent magnets, an equal and opposite force will be created and will try to cause a movement of said first board assembly that may be mitigated by the connecting structure enabling an amount of mass associated with said second board assembly to be added to an amount of mass associated with the first board assembly.

19. A yo-yo comprising:

first and second side portions secured together in a spaced-apart relation by an axle structure;

a tether operatively connected to said axle structure;

wherein said first side portion comprises a body member and a freely rotatable board assembly;

wherein said board assembly comprises a board member, a sensor, an electromagnet and a controller, wherein said sensor, electromagnet and controller are operatively interconnected and are secured to said board member;

wherein an electrical power source is operatively connected to said sensor, electromagnet, and controller;

wherein said body member can rotate relative to said board assembly, wherein at least one permanent magnet is fixedly secured to said body member and is positioned to pass adjacent said sensor when said body member is rotating relative to said board member and wherein said sensor is of a type whereby said sensor will be affected when said magnet passes adjacent said sensor;

wherein when said body member is rotating relative to said board member and said sensor is affected by the passage of said at least one permanent magnet, said electromagnet will be actuated at a time when one of said at least one permanent magnets is substantially adjacent said electromagnet whereby said electromagnet will apply a force on said substantially adjacent permanent magnet in a manner that helps to maintain a rotational momentum of said body member; and wherein said board assembly has a center of mass and wherein when said yo-yo is sleeping and has a horizontally-oriented axis of rotation, said center of mass will be located offset from said center of rotation and wherein said board member has a shape that enables said sensor and electromagnet to be located in a manner that maximizes a distance between said center of mass and said center of rotation.

20. The yo-yo of claim 19 wherein said board member has a shape that is non-symmetric about said center of rotation.

* * * * *